US008245789B2

(12) United States Patent
Holderman et al.

(10) Patent No.: US 8,245,789 B2
(45) Date of Patent: Aug. 21, 2012

(54) APPARATUS AND METHOD FOR FLUIDICALLY COUPLING TUBULAR SECTIONS AND TUBULAR SYSTEM FORMED THEREBY

(75) Inventors: Luke W. Holderman, Plano, TX (US); Stephen Michael Greci, McKinney, TX (US); Jean-Marc Lopez, Plano, TX (US)

(73) Assignee: Halliburton Energy Service, Inc., Houston, TX (US)

( * ) Notice: Subject to any disclaimer, the term of this patent is extended or adjusted under 35 U.S.C. 154(b) by 184 days.

(21) Appl. No.: 12/821,733

(22) Filed: Jun. 23, 2010

(65) Prior Publication Data

US 2011/0315369 A1 Dec. 29, 2011

(51) Int. Cl.
*E21B 19/18* (2006.01)
*E21B 19/16* (2006.01)

(52) U.S. Cl. ..... 166/380; 166/77.51; 166/235; 166/85.1; 166/236

(58) Field of Classification Search ..... 166/77.51, 166/235, 380, 379, 85.1, 236; 285/333, 334, 285/382; 29/456, 506, 508, 521
See application file for complete search history.

(56) References Cited

U.S. PATENT DOCUMENTS 4,284,138 A 8/1981 Allred
5,092,152 A * 3/1992 Miller et al. ..... 72/402
5,751,895 A 5/1998 Bridges
5,931,232 A * 8/1999 Echols et al. ..... 166/378
6,446,729 B1 9/2002 Bixenman et al.
6,457,518 B1 10/2002 Castano-Mears et al.
6,681,854 B2 1/2004 Danos
6,695,054 B2 2/2004 Johnson et al.
6,776,241 B2 8/2004 Castano-Mears et al.
6,789,621 B2 9/2004 Wetzel et al.
6,793,021 B1 * 9/2004 Fanguy ..... 166/380
6,817,410 B2 11/2004 Wetzel et al.
6,848,510 B2 2/2005 Bixenman et al.
6,863,131 B2 3/2005 Richard
6,983,796 B2 1/2006 Bayne et al.
7,048,061 B2 * 5/2006 Bode et al. ..... 166/369
7,104,324 B2 9/2006 Wetzel et al.
7,108,062 B2 9/2006 Castano-Mears et al.
7,131,494 B2 11/2006 Bixenman et al.
7,182,134 B2 2/2007 Wetzel et al.
7,222,676 B2 5/2007 Patel et al.
7,431,085 B2 10/2008 Coronado et al.
7,441,605 B2 10/2008 Coronado et al.
7,584,799 B2 9/2009 Coronado et al.
7,681,640 B2 3/2010 Bixenman et al.
7,717,178 B2 5/2010 Gaudette et al.
2008/0196879 A1 8/2008 Broome et al.

* cited by examiner

*Primary Examiner* — Cathleen Hutchins
(74) *Attorney, Agent, or Firm* — Lawrence R. Youst

(57) ABSTRACT

An apparatus for connecting an outer tubular (236) and an inner tubular (218) on a well platform by applying a crimping force to the outer tubular (236) when the outer tubular (236) is disposed about the inner tubular (218) and the inner tubular (218) is suspending from the well platform. The apparatus includes a support assembly (244) operably associated with the well platform and a crimping assembly (242) operably associated with the support assembly (244). The crimping assembly (242) is operable to mechanically deform the outer tubular (236) into contact with the inner tubular (218).

12 Claims, 6 Drawing Sheets

APPARATUS AND METHOD FOR FLUIDICALLY COUPLING TUBULAR SECTIONS AND TUBULAR SYSTEM FORMED THEREBY

TECHNICAL FIELD OF THE INVENTION

This invention relates, in general, to equipment utilized in conjunction with operations performed in subterranean wells and, in particular, to an apparatus and method for fluidically coupling tubular sections on a well platform to establish a dual flow path between adjacent tubular sections and the tubular system formed thereby.

BACKGROUND OF THE INVENTION

Without limiting the scope of the present invention, its background will be described with reference to producing fluid from a hydrocarbon bearing subterranean formation, as an example.

During the completion of a well that traverses a hydrocarbon bearing subterranean formation, production tubing and various completion equipment are installed in the well to enable safe and efficient production of the formation fluids. For example, to prevent the production of particulate material from an unconsolidated or loosely consolidated subterranean formation, certain completions include one or more sand control screens positioned proximate the desired production interval or intervals. In other completions, to control the flow rate of production fluids into the production tubing, it is common practice to install one or more flow control devices within the tubing string.

Attempts have been made to utilize fluid flow control devices within completions requiring sand control. For example, in certain sand control screens, after production fluids flows through the filter medium, the fluids are directed into a flow control section. The flow control section may include one or more flow restrictors such as flow tubes, nozzles, labyrinths or the like. Typically, the production rate through these flow control screens is fixed prior to installation by individually adjusting the flow restrictors of the flow control screens.

It has been found, however, that the use of flow control screens as each of the screening elements in a completion string adds unnecessary cost and complexity to the completion. Accordingly, a need has arisen for a completion string that is operable to control the inflow of formation fluids in a completion requiring sand control that does not require the use of flow control screens as each of the screening elements.

SUMMARY OF THE INVENTION

The present invention disclosed herein comprises an apparatus and method for fluidicially coupling tubular sections on a well platform to establish a dual flow path between adjacent tubular sections and the tubular system formed thereby. In one implementation, the tubular system may be in the form of a completion string that is operable to control the inflow of formation fluids in a completion requiring sand control that does not require the use of flow control screens as each of the screening elements.

In one aspect, the present invention is directed to a method for connecting tubular sections on a well platform. The method includes providing a crimping assembly, providing first and second tubular sections, the second tubular section having a sleeve disposed thereabout, suspending the first tubular section from the well platform, threadably engaging the second tubular section with the first tubular section forming a coupled joint, locating the sleeve over the coupled joint, wherein a first portion of the sleeve is disposed about the first tubular section and a second portion of the sleeve is disposed about the second tubular section, crimping the second portion of the sleeve with the crimping assembly to connect the sleeve to the second tubular section and crimping the first portion of the sleeve with the crimping assembly to connect the sleeve to the first tubular section.

In one embodiment, the method may involve establishing a flow path between the first and second tubular sections in a region between the interior of the sleeve and the exterior of the coupled joint. In another embodiment, the method may involve pneumatically operating the crimping assembly or hydraulically operating the crimping assembly.

The method may further involve providing first and second tubular screen sections, suspending the first tubular section from a screen table located on the well platform, threadably engaging the second tubular section with the first tubular section forming a coupled joint, removing the screen table, supporting the first and second tubular screen sections with a block assembly of the well platform and establishing a flow path between the first and second tubular screen sections in a region between the interior of the sleeve and the exterior of the coupled joint.

In another aspect, the present invention is directed to an apparatus for connecting an outer tubular and an inner tubular on a well platform by applying a crimping force to the outer tubular when the outer tubular is disposed about the inner tubular and the inner and outer tubulars are suspended from the well platform. The apparatus includes a support assembly operably associated with the well platform and a crimping assembly operably associated with the support assembly. The crimping assembly is operable to crimp the outer tubular into contact with the inner tubular.

In one embodiment, the crimping assembly includes an enclosure having a pipe receiving region. The enclosure has a rear assembly and a pair of oppositely disposed arm assemblies. The arm assemblies are rotatable relative to the rear assembly between an open position wherein the enclosure is operable to receive and release the outer tubular member and a closed position wherein the enclosure is operable to crimp the outer tubular into contact with the inner tubular. In this embodiment, the crimping assembly may include a locking assembly for maintaining the crimping assembly the closed position during crimping. Also, in this embodiment, the crimping assembly may include a plurality of radially actuated piston members operable to engage the outer tubular member and crimp the outer tubular member into contact with the inner tubular member. In one embodiment, the crimping assembly may include a pneumatic motor. In another embodiment, the crimping assembly may include a hydraulic motor.

In another aspect, the present invention is directed to a completion assembly for installation in a wellbore positioned below a well platform. The completion assembly includes first and second tubular screen sections that are threadably engaged with one another to form a coupled joint on the well platform. The tubular screen sections each have a nonperforated base pipe, an outer housing disposed about the base pipe and forming a fluid flow path therebetween and a filter medium disposed about the base pipe. A sleeve is positioned over the coupled joint, wherein a first portion of the sleeve is crimped on the well platform into contact with the outer housing of the first tubular screen section and wherein a second portion of the sleeve is crimped on the well platform into contact with the outer housing of the second tubular screen section, such that the sleeve establishes a flow path between the first and second tubular screen sections in a region between the interior of the sleeve and the exterior of the coupled joint.

In one embodiment, the completion assembly includes a flow control assembly that is in fluid communication with the first and second tubular screen sections. The flow control assembly is operable to control fluid inflow into an interior of the completion assembly. In another embodiment, the outer housing of the second tubular screen section includes a disconnection ring. In this embodiment, the sleeve is crimped into contact with the disconnection ring which enables threadable release of the sleeve from the second tubular screen section. Also, in this embodiment, the disconnection ring and the sleeve may each have a mating profile for locating the sleeve relative to the first and second tubular screen sections prior to crimping. In another embodiment, a seal may be positioned between the sleeve and the outer housing of the second tubular screen section, the outer housing of the first tubular screen section or both.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
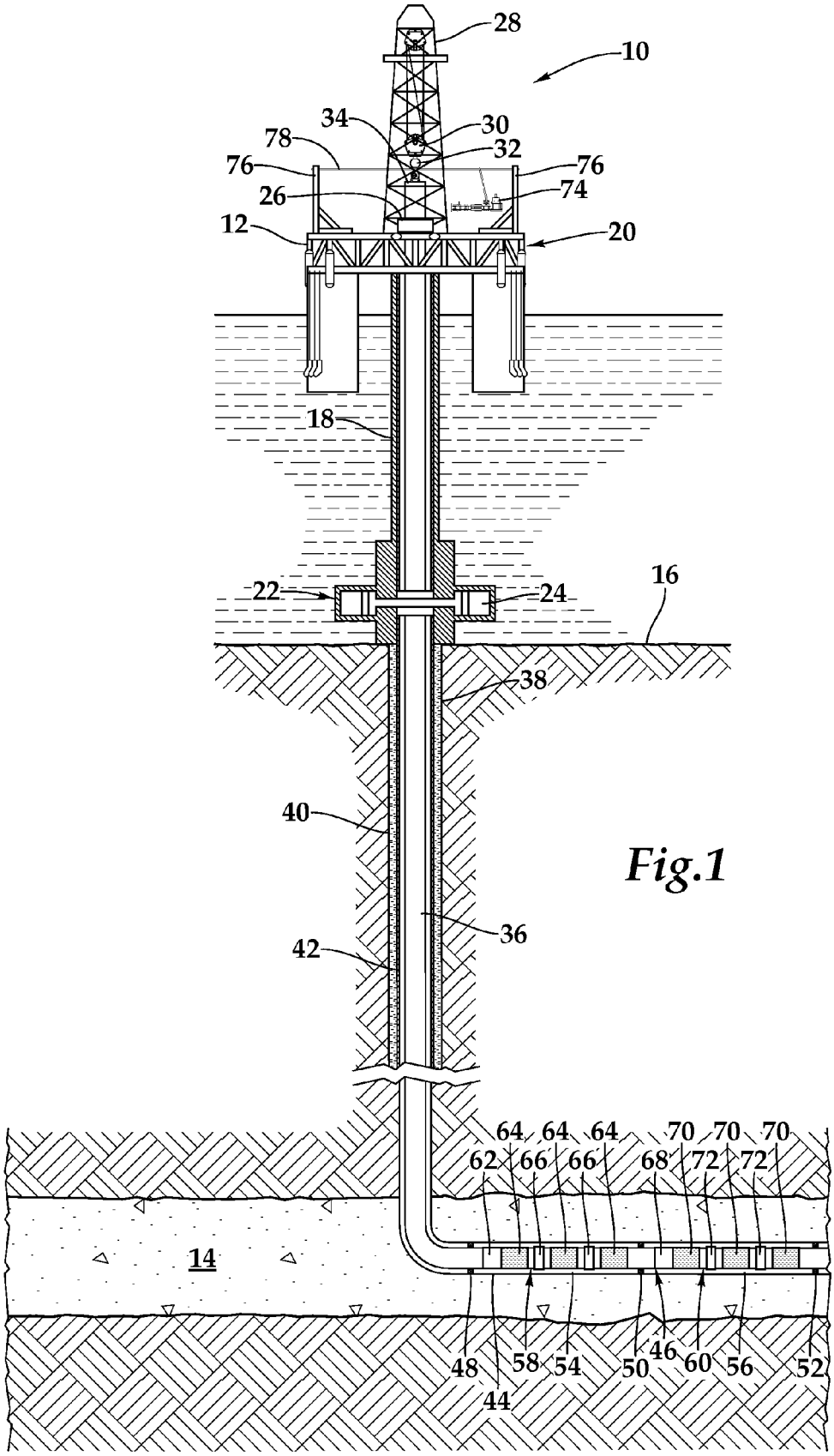
FIG. 1 is a schematic illustration of a completion assembly formed according to an embodiment of the present invention that is being installed from an offshore well platform.

Referring initially to FIG. 1, therein is depicted a completion string embodying principles of the present invention being deployed from an offshore well platform that is schematically illustrated and generally designated 10. As depicted, a semi-submersible well platform 12 is centered over a submerged oil and gas formation 14 located below sea floor 16. A subsea conduit extends from well floor 20 of platform 12 to wellhead installation 22 including subsea blow-out preventers 24. Platform 12 has a rotary table 26, a derrick 28, a travel block 30, a hook 32 and a swivel 34 for raising and lowering pipe strings, such as a tubing string 36. A wellbore 38 extends through the various earth strata including formation 14. Wellbore 38 has a substantially vertical section 40, the upper portion of which has a casing string 42 cemented therein. Wellbore 38 also has a substantially horizontal section 44 that extends through formation 14. As illustrated, substantially horizontal section 44 of wellbore 38 is open hole.

Tubing string 36 provides a conduit for formation fluids to travel from formation 14 to the surface. At its lower end, tubing string 36 is coupled to a completion string 46 that has been installed in the completion interval of wellbore 38. Completion string 46 includes a plurality of packers 48, 50, 52 that divide the completion interval into production intervals 54, 56. Within each production interval 54, 56, completion string 46 includes a completion assembly 58, 60 that is operable to filter particulate matter out of the production fluid stream and control the inflow rate of the production fluid stream.

As illustrated, completion assembly 58 includes a flow control device 62 that may be in the form of a fixed or variable choke or other flow restricting device having an orifice or utilizing flow tubes, nozzles, labyrinths or the like that are operable to control the flow rate of fluids from formation 14 into the interior of flow control device 62. Completion assembly 58 also includes a plurality of sand control screen assemblies 64 that may have one or more wire wrapped filter media, a prepacked filter media, a multilayer wire mesh filter media or the like that are operable to allow fluid flow therethrough but prevent the passages of particles of a predetermined sized from passing therethrough. Each of the sand control screen assemblies 64 is fluidically coupled to an adjacent sand control screen assembly 64 with a dual path sleeve assembly that is operable to create a fluid flow path between adjacent sand control screen assemblies 64 in the region between the interior of dual path sleeve assembly 66 and the exterior of the coupled joint that connects adjacent sand control screen assemblies 64. As illustrated, flow control device 62 may be integral with one of the sand control screen assemblies 64 or may be a standalone tool within completion assembly 58. In a like manner, completion assembly 60 includes a flow control device 68 and a plurality of sand control screen assemblies 70 having dual path sleeve assemblies 72 positioned therebetween.

During assembly, and by way of example, dual path sleeve assemblies 66, 72 are mechanically deformed into contact with sand control screen assemblies 64, 70 on well platform 12 using a crimping assembly 74. Preferably, crimping assembly 74 is located proximate to rotary table and is movable relative thereto. In the illustrated embodiment, crimping assembly 74 is being supported by a support assembly 76 that includes a support wire 78 that enables crimping assembly 74 be slidably maneuvered into position to receive and crimp dual path sleeve assemblies 66 when completion assemblies 58, 60 are being supported by block 30. Alternatively, crimping assembly 74 could be supported within derrick 28 or by the hoisting apparatus of well platform 12.

Once completion assemblies 58, 60 are installed in wellbore 38, production fluid from formation 14 enters production intervals 54, 56, passing through completion assemblies 58, 60 before entering tubing string 36. By way of example, the production fluid that enters production interval 54 passes through the filter medium of one of the sand control screen assemblies 64 and travels toward flow control device 62. Preferably, each of the sand control screen assemblies 64 has a base pipe that is in the form of a blank pipe with no perforations such that the fluid entering completion interval 54 may pass through any one of the sand control screen assemblies 64 but must travel through flow control device 62 in order to enter tubing string 36. More specifically, the production fluid that enters one of the sand control screen assemblies 64 that is not adjacent to flow control device 62 passes through one or more dual path sleeve assemblies 66 that create a fluid path around the exterior of the sand control screen assemblies 64 over the jointed connections or couplings. In this manner, a single flow control device 62 can be used to control the flow rate of the production fluid stream being produced through a plurality of sand control screen assemblies 64.

Even though FIG. 1 depicts completion assemblies 58, 60 in an open hole environment, it should be understood by those skilled in the art that the apparatuses, systems and methods of the present invention are equally well suited for use in cased wells. Also, even though FIG. 1 depicts a specific number of sand control screen assemblies being fluidically coupled together with dual path sleeve assemblies in each production interval, it should be understood by those skilled in the art that any number of sand control screen assemblies that are fluidically coupled together with dual path sleeve assemblies may be deployed within a production interval without departing from the principles of the present invention. In addition, even though FIG. 1 depicts a single completion assembly in each production interval, it should be understood by those skilled in the art that any number of completion assemblies may be deployed within a production interval without departing from the principles of the present invention. Further, even though FIG. 1 depicts an offshore well platform, it should be understood by those skilled in the art that the apparatuses, systems and methods of the present invention are equally well suited for use in association with onshore well platforms.

Even though FIG. 1 depicts a horizontal completion, it should be understood by those skilled in the art that the apparatuses, systems and methods of the present invention are equally well suited for use in well having other directional configurations including vertical wells, deviated wells, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2A:
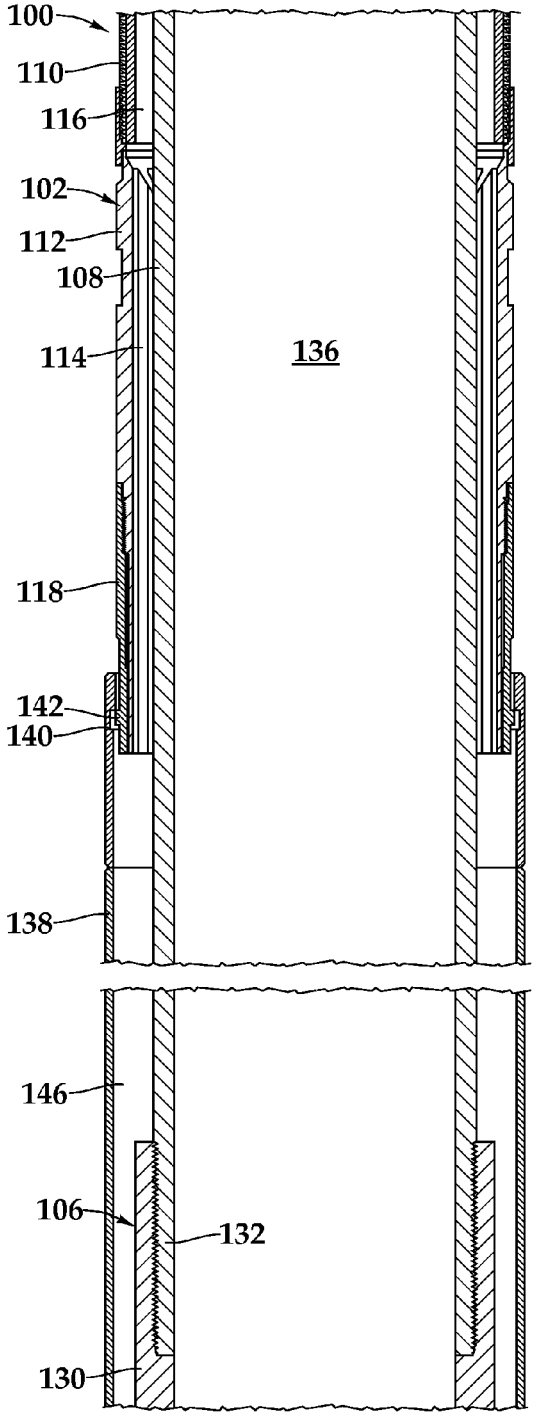
FIGS. 2A-2B are cross sectional views of consecutive axial sections of a completion assembly formed according to an embodiment of the present invention.
Figure 2B:
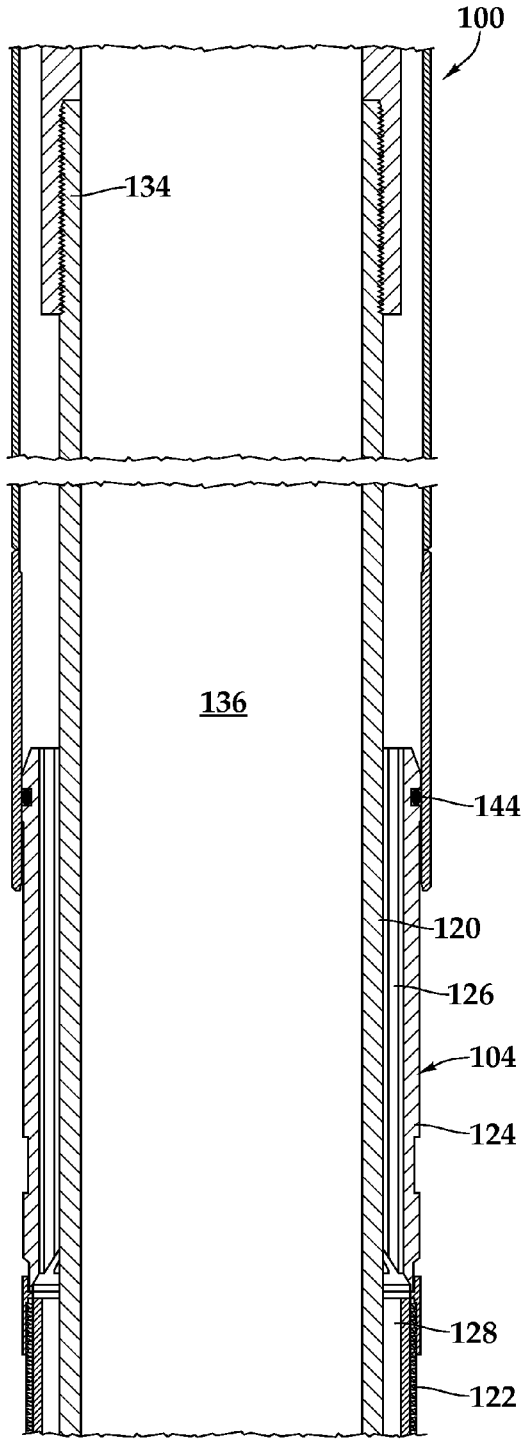

Referring next to FIGS. 2A-2B, therein are depicted consecutive axial sections of a completion assembly formed according to an embodiment of the present invention that is generally designated 100. Completion assembly 100 includes upper and lower tubular screen sections 102, 104 that are threadably engaged with one another to form a coupled joint 106. Screen section 102 includes a base pipe 108 depicted as a blank pipe having no perforations. Screen section 102 also includes a filter medium 110 that is depicted as a single layer wire wrapped screen but may be any desired screen type suitable for the intended purpose of completion assembly 100 as would be known by those skilled in the art. At its lower end, filter medium 110 is coupled to an outer housing 112. Preferably, filter medium 110 and outer housing 112 are welded together but other suitable coupling techniques could alternatively be used. In the illustrated embodiment, outer housing 112 forms an annulus 114 with base pipe 108 that is in fluid communication with an annulus 116 between filter medium 110 and base pipe 108. Threadably coupled to the lower end of outer housing 112 is a disconnection ring 118. Similarly, screen section 104 includes a base pipe 120 depicted as a blank pipe having no perforations. Screen section 104 also includes a filter medium 122. At its upper end, filter medium 122 is coupled to an outer housing 124. In the illustrated embodiment, outer housing 124 forms an annulus 126 with base pipe 120 that is in fluid communication with an annulus 128 between filter medium 122 and base pipe 120. Coupled joint 106 includes an internally threaded collar 130 that receives the lower threaded pin end 132 of base pipe 108 and the upper threaded pin end 134 of base pipe 120. In this manner, an internal fluid path 136 is formed within completion assembly 100.

Completion assembly 100 includes a dual path sleeve assembly 138 that extends between the lower end of outer housing 112 and the upper end of outer housing 124. In the illustrated embodiment, the upper end of sleeve assembly 138 has an internal mating profile 140 that receives an external mating profile 142 of disconnection ring 118. This interaction enables proper positioning of sleeve assembly 138 relative to the other parts of completion assembly 100 to insure proper alignment prior to crimping sleeve assembly 138 in place. Preferably, the upper end of outer housing 120 includes a seal element, depicted as o-ring 144, which provides as seal between sleeve assembly 138 and outer housing 124 upon crimping. Alternatively or additionally, a seal element may be positioned between sleeve assembly 138 and outer housing 112. Once sleeve assembly is positioned as illustrated and is mechanically deformed into crimping contact with outer housing 112 and outer housing 124, a fluid pathway 146 is established between upper and lower tubular screen sections 102, 104 between the interior of sleeve assembly 138 and the exterior of coupled joint 106. In embodiments that do not include a seal between sleeve assembly 138 and either outer housing 112, outer housing 120 or both, a metal-to-metal seal may be established therebetween. It should be understood by those skilled in the art, however, that the relationship between sleeve assembly 138 and outer housings 112, 120 need only be sufficiently close fitting to exclude sand particles of a size to also be excluded by filter media 110, 122, but not necessarily fluid tight, i.e., a sand control fit. In this configuration, fluid entering annulus 128 through filter medium 122 travels through annulus 126 into fluid pathway 146, then through annulus 114 and annulus 116. In a similar manner, fluid entering any such tubular screen section of a completion assembly of the present invention travels along a similar flow path until such fluid encounters a flow control device as discussed above and enters the interior of the tubing string.

Figure 3A:
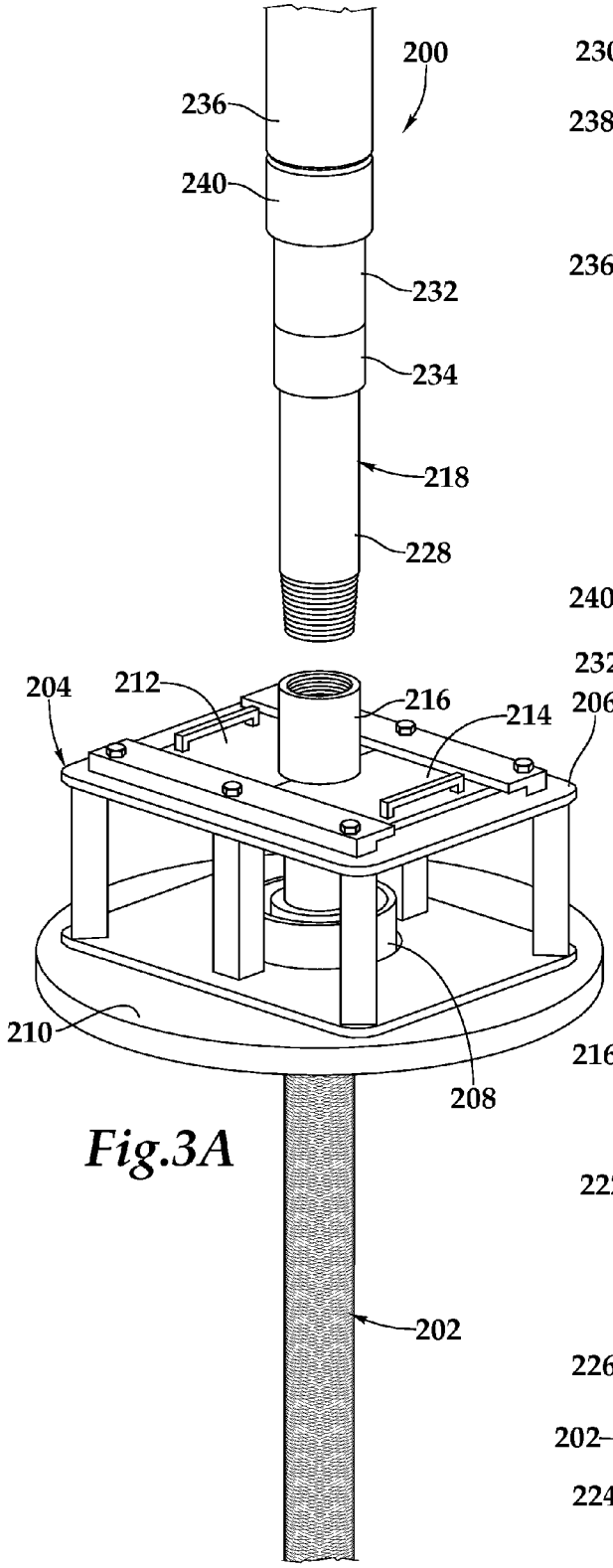
FIGS. 3A-3E are side views of a completion assembly in various assembly stages being formed according to an embodiment of the present invention.

Referring next to FIGS. 3A-3E, therein are depicted a completion assembly 200 of the present invention in various assembly stages. In FIG. 3A, a lower tubular section depicted as tubular screen section 202 is being supported by the well platform and specifically suspended from a screen table assembly 204. Screen table assembly 204 includes a support platform 206 that is attached to rotary table 208 generally located on well floor 210 of the well platform. Use of screen table assembly 204 is preferred when installing tubular screen sections to prevent damaging the screen sections during assembly. As the screen sections are being run in the wellbore, capture doors 212, 214 are positioned below the collar 216 of tubular screen section 202 enabling completion assembly 200 to be suspended from screen table assembly 204 while an upper tubular section depicted as tubular screen section 218 is maneuvered into position above screen section 202 using the hoisting apparatus of the well platform. Once screen sections 202 and 218 are threadably connected to form coupled joint 220, completion assembly 200 may be supported by the hoisting apparatus of the well platform. Thereafter, capture doors 212, 214 of screen table assembly 204 may be opened to release completion assembly 200 and screen table assembly 204 may be relocated.

Figure 3B:
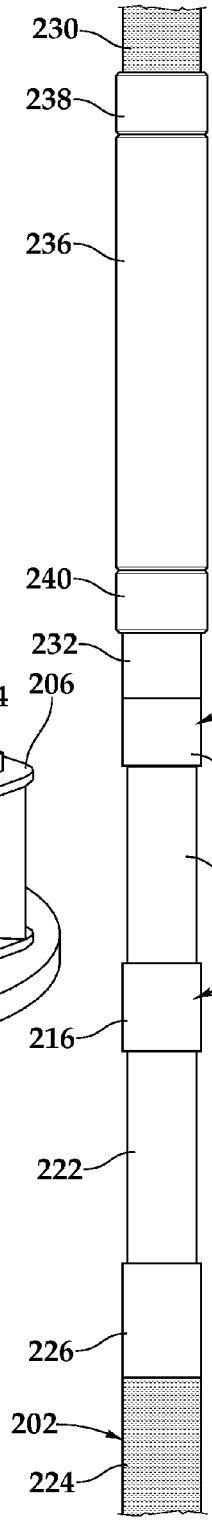
Figure 3C:
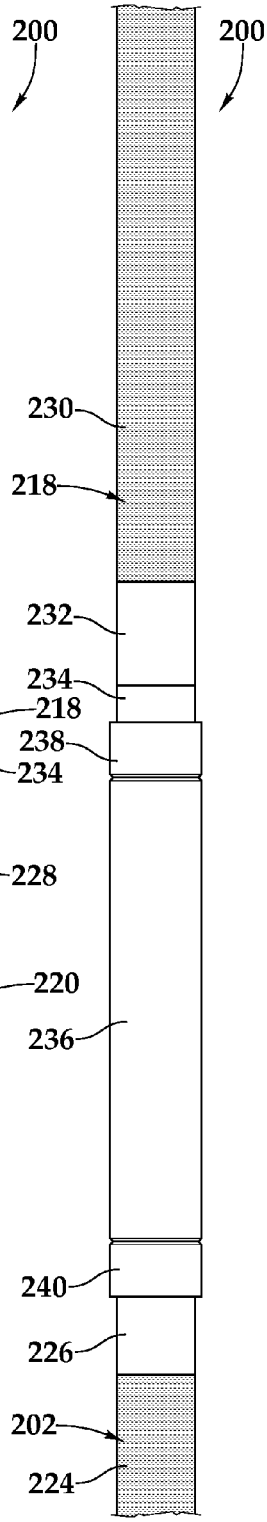

As best seen in FIG. 3B, completion assembly 200 is similar in design to completion assembly 100. In the illustrated portions, screen section 202 includes a base pipe 222, a filter medium 224 and an outer housing 226 that forms an annulus with base pipe 222. Similarly, screen section 218 includes a base pipe 228, a filter medium 230 and an outer housing 232 that forms an annulus with base pipe 228 and includes a disconnection ring 234. In FIG. 3B, completion assembly 200 is being supported by the hoisting apparatus of the well platform after screen table assembly 204 has been relocated. In this position, a dual path sleeve assembly 236, which is originally carried by screen section 218, may be shifted downwardly into position traversing coupled joint 220 and extending between screen section 218 and screen section 202, as best seen in FIG. 3C. As discussed above, the upper end of sleeve assembly 236 may preferably include an internal mating profile that receives an external mating profile of disconnection ring 234, which enables proper positioning of sleeve assembly 236 relative to the other parts of completion assembly 200 and specifically to align crimping collar 238 of sleeve assembly 236 with disconnection ring 234 and crimping collar 240 of sleeve assembly 236 with outer housing 226 of screen section 202.

Figure 3D:
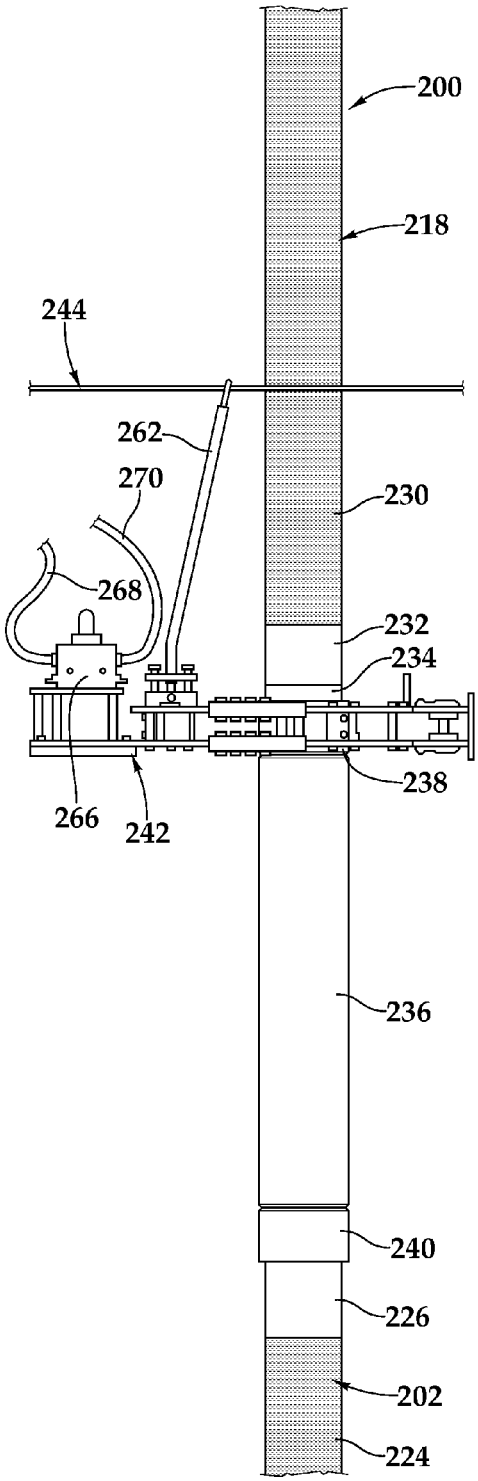
Figure 4A:
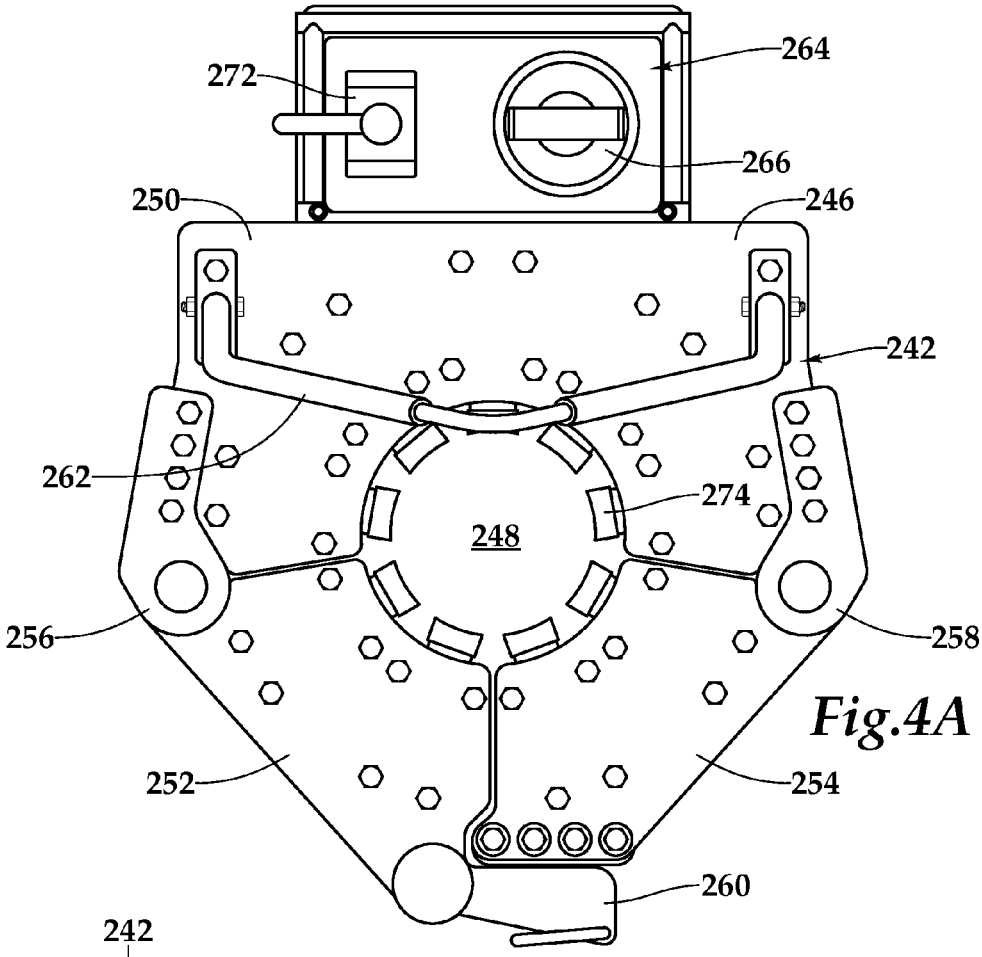
FIG. 4A is a top view of a crimping assembly operable to mechanically connect pipe sections on a well platform according to an embodiment of the present invention.

As best seen in FIG. 3D, once sleeve assembly 236 is properly positioned, a crimping assembly 242 deployed from a support assembly 244 of the well platform may be maneuvered into position around completion assembly 200. As best seen in FIG. 4A, crimping assembly 242 includes an enclosure assembly 246 having a pipe receiving region 248. Enclosure assembly 246 includes a rear assembly 250 and a pair of oppositely disposed arm assemblies 252, 254 that are rotatably coupled to rear assembly 248, respectively at hinges 256, 258 to enable crimping assembly 242 to receive and release tubular members. Enclosure assembly 246 also includes locking assembly 260 for maintaining crimping assembly 242 in the closed position during crimping operations. Crimping assembly 242 includes a lift assembly 262 that is operable to be coupled to support assembly 244 of the well platform and to allow movement of crimping assembly 242 relative to completion assembly 200. Crimping assembly 242 also has a control system 264 that includes a motor 266, such as a hydraulic motor, a pneumatic motor or the like that may be connected to one or more supply/return lines 268, 270 of the well platform, as well as power control switch 272.

Figure 3E:
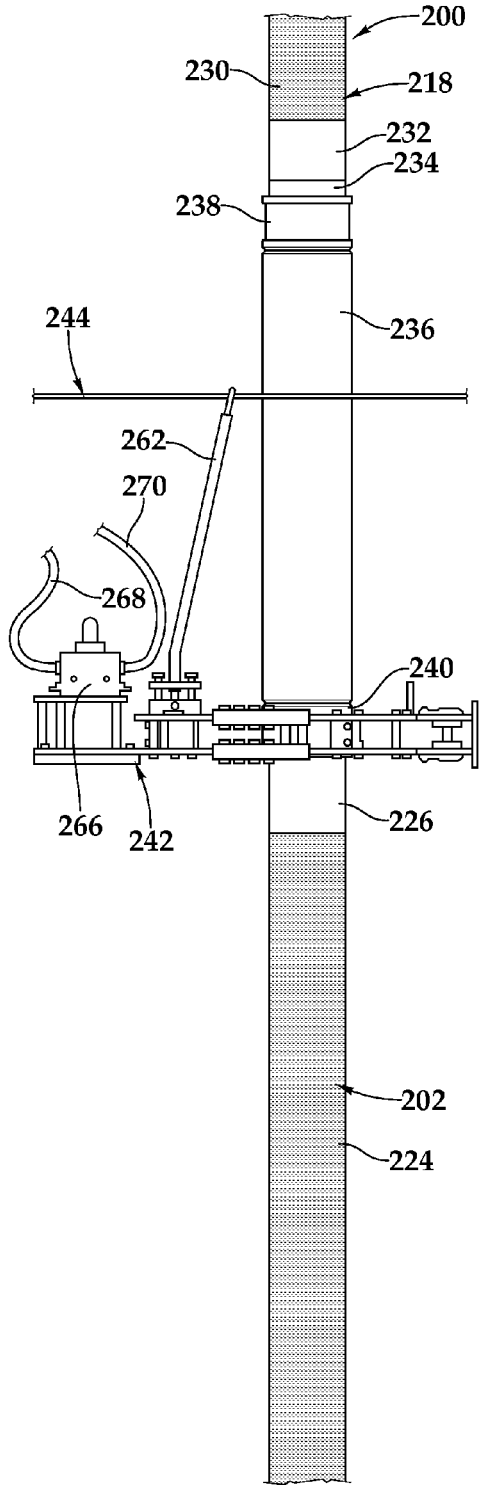
Figure 4B:
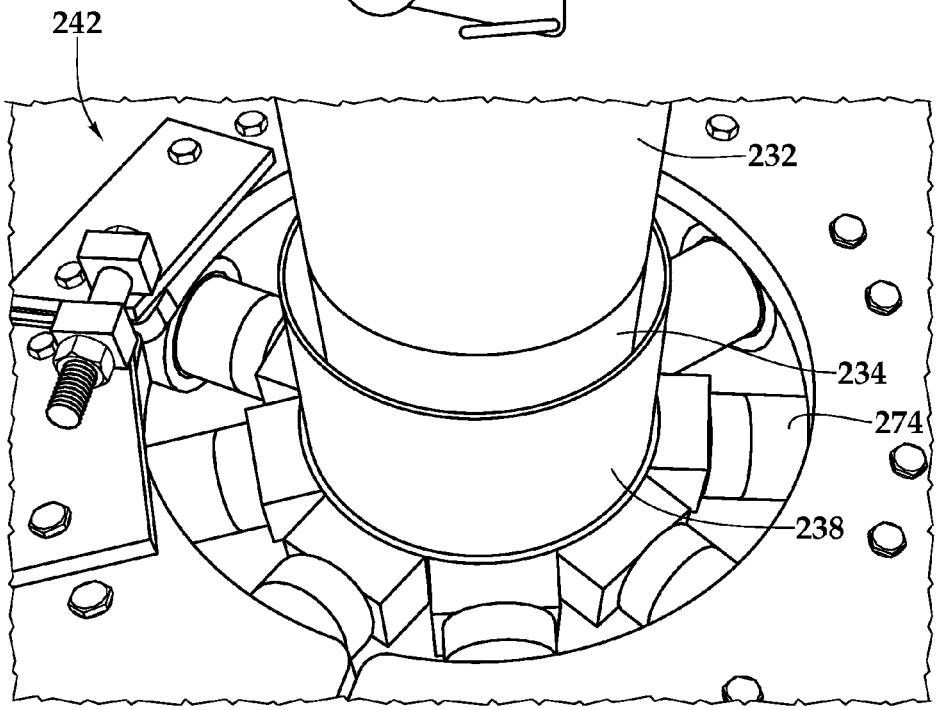
FIG. 4B is an enlarged view of a crimping assembly operable to mechanically connect pipe sections on a well platform according to an embodiment of the present invention during a crimping process.

Returning to FIG. 3D, once sleeve assembly 236 and crimping assembly 242 are properly positioned around completion assembly 200, crimping assembly 242 may be operated to mechanically deform crimping collar 238 into contact with disconnection ring 234. As best seen in FIG. 4B, crimping assembly 242 includes a plurality of radially actuated piston members 274 that are operable to engage the surface of crimping collar 238 and create a sufficient crimping force such that a mechanical connection is formed between crimping collar 238 and disconnection ring 234. After the crimping process of crimping collar 238 is complete, the crimping force is released and completion assembly 200 may be lifted by the hoisting apparatus of the well platform to align crimping collar 240 with crimping assembly 242, as best seen in FIG. 3E. The crimping process described above is then repeated to establish a mechanical connection between crimping collar 240 and outer housing 226 of screen section 202. As described above, once sleeve assembly 236 mechanically attached to screen section 202 and screen section 218, a flow path is created between screen section 202 and screen section 218 in a region between the interior of sleeve assembly 236 and the exterior of coupled joint 220. Thereafter, the screen section connection and sleeve crimping process can be repeated for addition sections of screen to be attached within completion assembly 200.

Figure 3F:
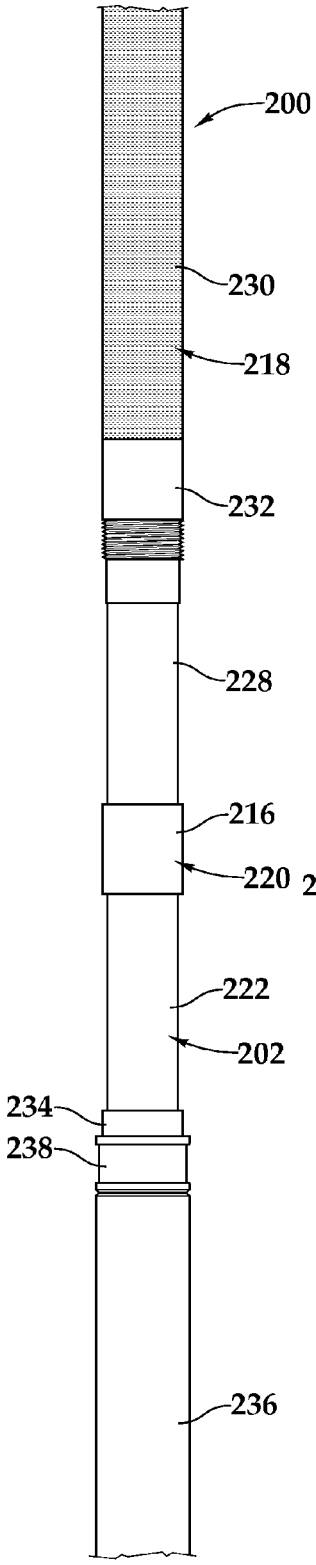
FIGS. 3F-3G are side views of a completion assembly in various disassembly stages according to an embodiment of the present invention.
Figure 3G:
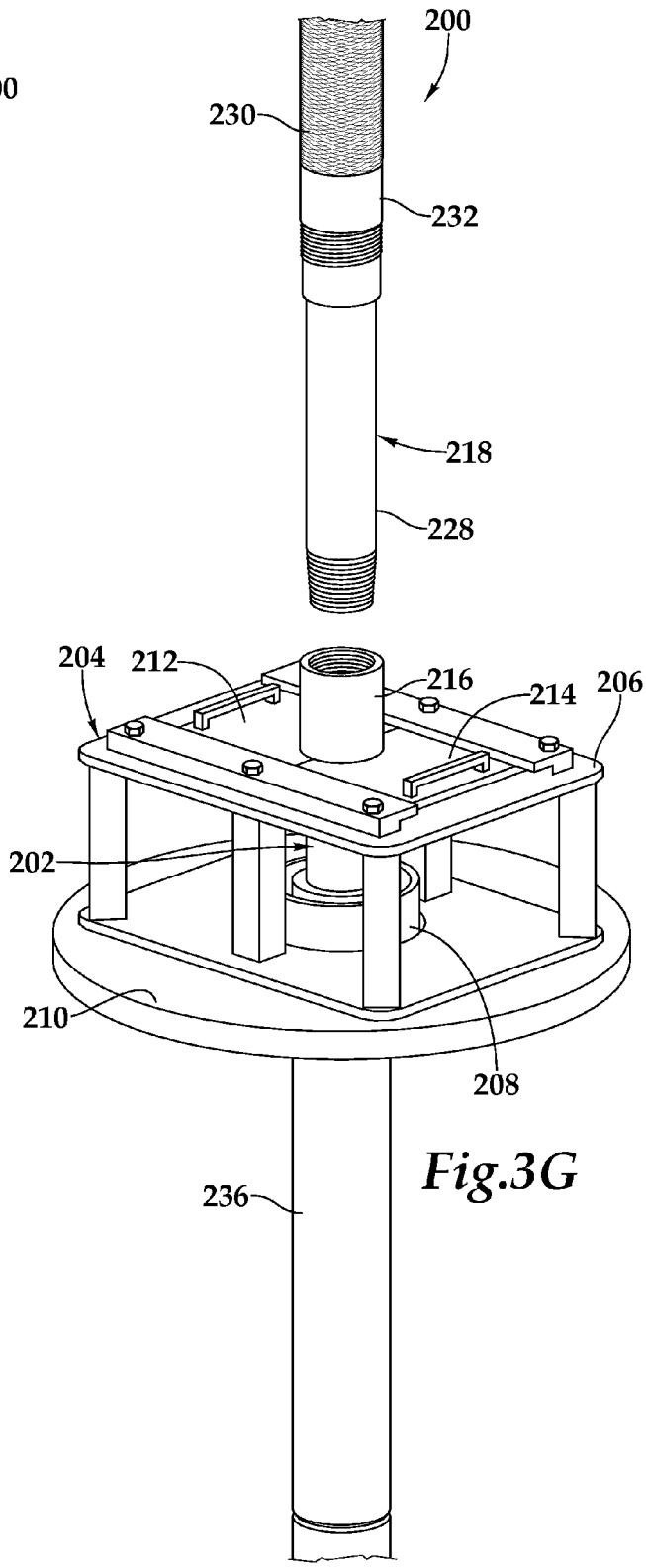

If it is desired to remove completion assembly 200 from the wellbore, the present invention enables disassembly of completion assembly 200. As best seen in FIG. 3F, completion string 200 may be lifted out of the wellbore using the hoisting apparatus of the well platform. Using standard tong and chain techniques, sleeve assembly 236 can be disconnected from screen section 218 as sleeve assembly 236 was initially mechanically connected to disconnection ring 234 which enables sleeve assembly 236 to be threadably released from screen section 218 by threadably decoupling disconnection ring 234 from outer housing 232. Sleeve assembly 236 may then be positioned around screen section 202 to expose coupled joint 220. Thereafter, screen table assembly 204 may be returned to its position proximate rotary table 208. As illustrated in FIG. 3G, capture doors 212, 214 are positioned below the collar 216 of screen section 202 enabling completion assembly 200 to be suspended from screen table assembly 204. Screen section 218 may then be threadably decoupled from screen section 202. This process can be repeated as required for additions screen sections.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A method for connecting tubular sections on a well platform, the method comprising:
   - providing a crimping assembly;
   - providing first and second tubular sections, the second tubular section having a disconnection ring disposed thereabout and threadably releasable therefrom;
   - suspending the first tubular section from the well platform;
   - threadably engaging the second tubular section with the first tubular section forming a coupled joint;
   - locating a sleeve over the coupled joint, wherein a first portion of the sleeve is disposed about the first tubular section and a second portion of the sleeve is disposed about the second tubular section by aligning a mating profile of the sleeve with a mating profile of the disconnection ring;
   - crimping the second portion of the sleeve with the crimping assembly to connect the sleeve to the disconnection ring; and
   - crimping the first portion of the sleeve with the crimping assembly to connect the sleeve to the first tubular section.

2. The method as recited in claim 1 wherein providing first and second tubular sections further comprises providing first and second tubular screen sections.

3. The method as recited in claim 2 wherein suspending the first tubular section from the well platform further comprises suspending the first tubular screen section from a screen table located on the well platform.

4. The method as recited in claim 3 wherein, after threadably engaging the second tubular section with the first tubular section forming a coupled joint, removing the screen table and supporting the first and second tubular screen sections with a hoisting apparatus of the well platform.

5. The method as recited in claim 2 further comprising establishing a flow path between the first and second tubular screen sections in a region between the interior of the sleeve and the exterior of the coupled joint.

6. The method as recited in claim 1 further comprising establishing a flow path between the first and second tubular sections in a region between the interior of the sleeve and the exterior of the coupled joint.

7. The method as recited in claim 1 wherein crimping the sleeve further comprises pneumatically operating the crimping assembly.

8. The method as recited in claim 1 wherein crimping the sleeve further comprises hydraulically operating the crimping assembly.

9. A completion assembly for installation in a wellbore positioned below a well platform, the completion assembly comprising:

first and second tubular screen sections threadably engaging one another to form a coupled joint on the well platform, the tubular screen sections each having a base pipe, an outer housing disposed about the base pipe and forming a fluid flow path therebetween and a filter medium disposed about the base pipe;

a disconnection ring disposed about and threadably releasable from the second tubular screen section; and a sleeve positioned over the coupled joint, wherein a first portion of the sleeve is crimped on the well platform into contact with the outer housing of the first tubular screen section and wherein a second portion of the sleeve is crimped on the well platform into contact with the disconnection ring, such that the sleeve establishes a flow path between the first and second tubular screen sections in a region between the interior of the sleeve and the exterior of the coupled joint;

wherein the disconnection ring and the sleeve each have a mating profile for locating the sleeve relative to the first and second tubular screen sections prior to crimping.

10. The completion assembly as recited in claim 9 further comprising a flow control assembly in fluid communication with the first and second tubular screen sections that is operable to control fluid inflow into an interior of the completion assembly.

11. The completion assembly as recited in claim 9 further comprising a seal positioned between the sleeve and the outer housing of the second tubular screen section.

12. The completion assembly as recited in claim 9 further comprising a seal positioned between the sleeve and the outer housing of the first tubular screen section.

* * * * *